US006155912A

United States Patent [19]

Chen et al.

[11] Patent Number: 6,155,912

[45] Date of Patent: Dec. 5, 2000

[54] CLEANING SOLUTION FOR CLEANING A POLISHING PAD USED IN A CHEMICAL-MECHANICAL POLISHING PROCESS

[75] Inventors: Hsueh-Chung Chen, Yungho; Ming-Sheng Yang; Juan-Yuan Wu, both of Hsin-Chu, all of Taiwan

[73] Assignee: United Microelectronics Corp., Hsin-Chu, Taiwan

[21] Appl. No.: 09/399,089

[22] Filed: Sep. 20, 1999

[51] Int. Cl.[7] ..... B24B 1/00

[52] U.S. Cl. ..... 451/56; 451/60; 451/444

[58] Field of Search ..... 510/175, 372, 510/375, 435, 397; 252/186.28, 186.43; 134/21.1, 22.17, 22.18, 22.19, 26, 29, 34, 36, 42; 451/28, 36, 60, 443, 444, 56

[56] References Cited

U.S. PATENT DOCUMENTS

| | | | |
|---|---|---|---|
| 5,478,436 | 12/1995 | Winebarger et al. | 156/636.1 |
| 6,030,932 | 2/2000 | Leon et al. | 510/175 |
| 6,068,879 | 5/2000 | Pasch | 427/97 |

*Primary Examiner*—Derris H. Banks
*Attorney, Agent, or Firm*—Winston Hsu

[57] ABSTRACT

The present invention provides a cleaning solution for cleaning a polishing pad used in a chemical-mechanical polishing (CMP) process for polishing the surface of a semiconductor wafer. The cleaning solution comprises a potassium hydroxide (KOH) solution for cleaning off slurry remaining on the surface of the polishing pad, and a hydrogen peroxide ($H_2O_2$) solution and ammonia water ($NH_4OH$) solution for removing abrasive debris remaining on the surface of the polishing pad after the chemical-mechanical polishing process.

6 Claims, 2 Drawing Sheets

CLEANING SOLUTION FOR CLEANING A POLISHING PAD USED IN A CHEMICAL-MECHANICAL POLISHING PROCESS

BACKGROUND OF THE INVENTION

1. Field of the invention

The present invention relates to a cleaning solution, and more particularly, to a cleaning solution for cleaning a polishing pad.

2. Description of the prior art

In semiconductor processing, the deposition layer on a semiconductor wafer is polished using a chemical mechanical polishing (CMP) process so as to enhance its planarity. Dual-damascene processing forms a metallic layer and a plug at the same time and excess metal is removed by performing a metallic CMP process on the metallic layer. However, metallic debris and metallic oxides generated from this abrasion often remain on a polishing pad of a CMP machine. Once accumulated up to a certain extent, the abrasive efficiency of the metallic CMP process will be lowered. This decreases the yield of semiconductor products.

Please refer to FIG. 1 to FIG. 3. FIG. 1 to FIG. 3 are schematic diagrams of a dual-damascene process according to the prior art. As shown in FIG. 1, a semiconductor wafer 10 employed in a dual-damascene process comprises a bottom dielectric layer 12, a bottom metallic layer 14 inlayed in the bottom dielectric layer 12, and an inter-metal dielectric (IMD) layer 16 positioned above the bottom dielectric layer 12 and the bottom metallic layer 14. The sectional shape of the bottom metallic layer 14 approximates that of a rectangle. The inter-metal dielectric layer 16 comprises a columnar opening 18 and a groove 20 installed astride the opening 18. In dual-damascene processing, a metallic layer 32 made of aluminum, copper or aluminum-copper alloy is formed evenly on the semiconductor wafer 10 filling in the groove 20 and the opening 18, as shown in FIG. 2. Then, a metallic CMP process is performed to remove the metallic layer 32 above the inter-metal dielectric layer 16 so as to form a dual-damascene structure 40, as shown in FIG. 3. The metallic layer 32 filled in the groove 20 is used as a metallic wire, and the metallic layer 32 filled in the opening 18 is used as a plug.

During CMP processing, an abundance of abrasive residue generated from the abrasion of the metallic layer 32 remains on the polishing pad of the CMP machine. Similarly, slurry used as a chemical reagent mixes with the abrasive residue to form slurry residue that adheres to the surface of the polishing pad. Although deion water (DI water) is used to clean the polishing pad according to the prior art, it is insufficient. Abrasive residue and slurry residue continue to accumulate on the polishing pad causing the useful life of the polishing pad and the abrasive effect of the metallic CMP process to be greatly decreased. Also, the stability of the dual-damascene structure 40 will be severely affected.

SUMMARY OF THE INVENTION

It is therefore a primary objective of the present invention to provide a cleaning solution for cleaning the polishing pad, which effectively removes the abrasive debris and slurry remaining on the polishing pad.

In a preferred embodiment, the present invention provides a cleaning solution for cleaning the polishing pad used in a chemical-mechanical polishing (CMP) process for polishing the surface of a semiconductor wafer, the cleaning solution comprising:

a potassium hydroxide (KOH) solution for cleaning off slurry remaining on the surface of the polishing pad; and a hydrogen peroxide ($H_2O_2$) solution and ammonia water ($NH_4OH$) solution for removing abrasive debris remaining on the surface of the polishing pad after the chemical-mechanical polishing process.

It is an advantage of the present invention that the cleaning solution comprises potassium hydroxide solution, hydrogen peroxide ($H_2O_2$) solution and ammonia water ($NH_4OH$) solution. This can effectively clean off abrasive debris and slurry remaining on the polishing pad. Therefore, not only the life of the polishing pad will be lengthened but also the abrasive efficiency of the CMP process will be increased.

This and other objective of the present invention will no doubt become obvious to those of ordinary skill in the art after having read the following detailed description of the preferred embodiment which is illustrated in the various figures and drawings.

DETAILED DESCRIPTION OF THE PREFERRED EMBODIMENT

Figure 1:
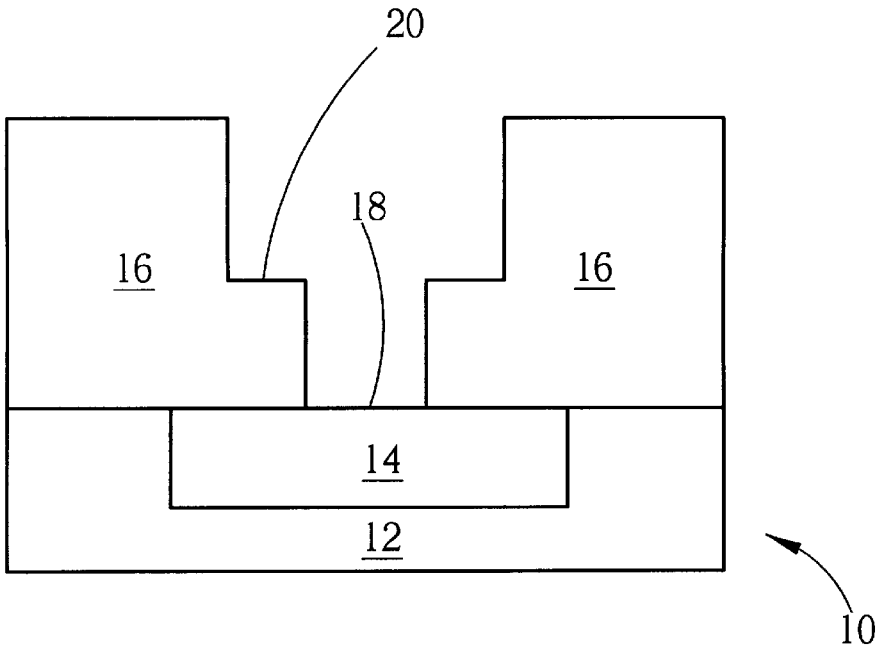
Fig. 1 Prior art
FIG. 1 to FIG. 3 are schematic diagrams of a dual-damascene process according to the prior art.
Figure 2:
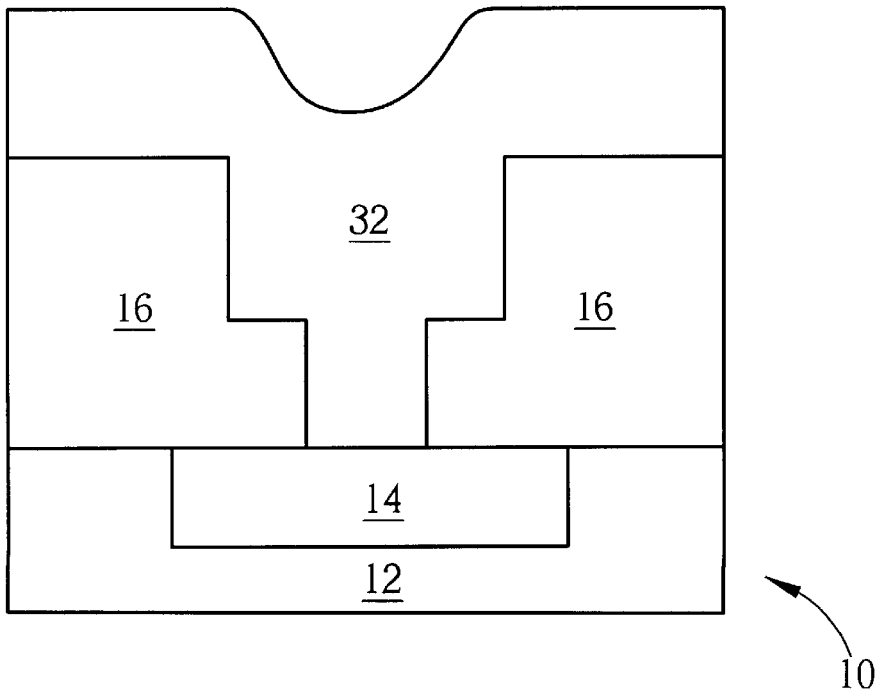
Fig. 2 Prior art
Figure 3:
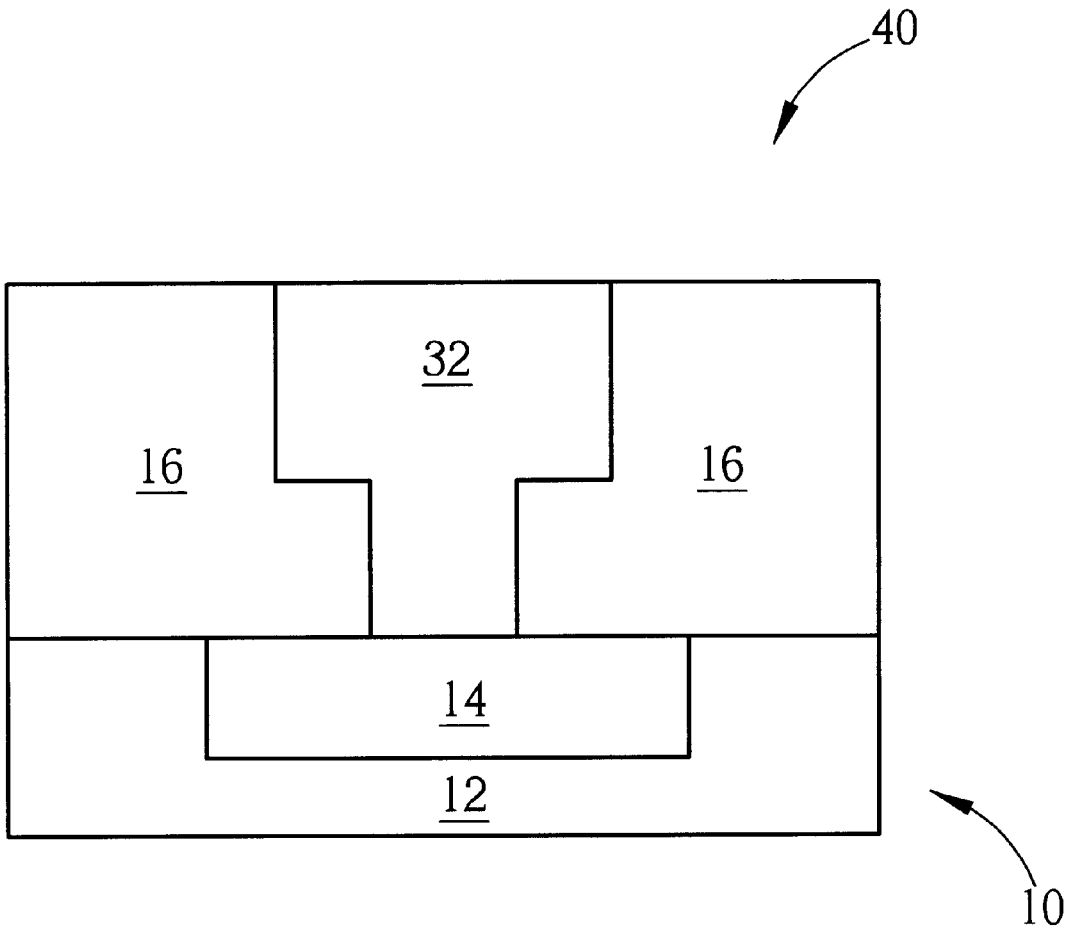
Fig. 3 Prior art

A cleaning solution according to the present invention is used for cleaning a polishing pad in a CMP process. The aim of the CMP process is to polish the metallic layer 32 of the dual-damascene structure 40 so as to increase the planarity of the semiconductor wafer 10. The cleaning solution comprises a potassium hydroxide (KOH) solution for cleaning off slurry remaining on the surface of the polishing pad, and a hydrogen peroxide ($H_2O_2$) solution and ammonia water ($NH_4OH$) solution for removing abrasive debris remaining on the surface of the polishing pad after the chemical-mechanical polishing process. The potassium hydroxide solution comprises 5–20% KOH by weight. The hydrogen peroxide solution comprises 3–10% $H_2O_2$ by weight. The ammonia water solution comprises 10–30% $NH_4$0H by weight.

In dual-damascene processing, the CMP process is performed on the metallic layer 32 positioned on the semiconductor wafer 10. The metallic layer 32 comprises aluminum, copper or an aluminum-copper alloy. During the CMP process, slurry comprising oxidant and organic agents is used as a chemical reagent wherein small numbers of particles of aluminum oxide ($Al_2O_3$) and silicon dioxide ($SiO_2$) easily adhere to the surface of the polishing pad. Also, large amounts of metallic debris generated from the abrasion of the metallic layer 32 remain on the polishing pad. As a result, the metallic debris and slurry on the polishing pad are intermixed to form slurry residue. Accordingly, the cleaning solution comprises potassium hydroxide solution, hydrogen peroxide ($H_2O_2$) solution and ammonia water ($NH_4OH$) solution and can effectively clean off debris and slurry. As a consequence, the life of the polishing pad is lengthened and the abrasive effect of the CMP process is increased.

Compared to the prior method of cleaning the polishing pad by DI water, the present invention cleaning solution for cleaning the polishing pad comprises potassium hydroxide solution, hydrogen peroxide ($H_2O_2$) solution and ammonia water ($NH_4OH$) solution. This can clean off abrasive debris and slurry residue remaining on the polishing pad. As a result, the life of the polishing pad is lengthened and the abrasive effect of the CMP process is increased. Therefore, the yield of semiconductor products is greatly increased.

Those skilled in the art will readily observe that numerous modifications and alterations of the device may be made while retaining the teaching of the invention. Accordingly, the above disclosure should be construed as limited only by the metes and bounds of the appended claims.

What is claimed is:

1. A cleaning solution for cleaning a polishing pad used in a chemical-mechanical polishing (CMP) process for polishing the surface of a semiconductor wafer, the cleaning solution comprising:

a potassium hydroxide (KOH) solution for cleaning off slurry remaining on the surface of the polishing pad; and a hydrogen peroxide ($H_2O_2$) solution and ammonia water ($NH_4OH$) solution for removing abrasive debris remaining on the surface of the polishing pad after the chemical-mechanical polishing process.

2. The cleaning solution of claim 1 wherein the potassium hydroxide solution comprises 5–20% KOH by weight, the hydrogen peroxide solution comprises 3–10% $H_2O_2$ by weight, and the ammonia water solution comprises 10–30% $NH_4OH$ by weight.

3. The cleaning solution of claim 1 wherein the semiconductor wafer comprises a metal layer positioned on its surface and the abrasive debris remaining on the polishing pad is generated from the abrasion of the metal layer during the chemical-mechanical polishing process.

4. The cleaning solution of claim 3 wherein the metal layer forms a dual-damascene structure.

5. The cleaning solution of claim 3 wherein the metal layer comprises aluminum, copper or aluminum-copper alloy.

6. The cleaning solution of claim 1 wherein the slurry comprises fine particles made of aluminum oxide ($Al_2O_3$) or silicon dioxide ($SiO_2$).

* * * * *